US009502015B1

(12) United States Patent
Coglitore

(10) Patent No.: US 9,502,015 B1
(45) Date of Patent: Nov. 22, 2016

(54) GUITAR WAIST BELT

(71) Applicant: Santo Joseph Coglitore, Charlotte, NC (US)

(72) Inventor: Santo Joseph Coglitore, Charlotte, NC (US)

( * ) Notice: Subject to any disclaimer, the term of this patent is extended or adjusted under 35 U.S.C. 154(b) by 0 days.

(21) Appl. No.: 14/945,144

(22) Filed: Nov. 18, 2015

(51) Int. Cl.
*G10G 5/00* (2006.01)

(52) U.S. Cl.
CPC ..... *G10G 5/005* (2013.01)

(58) Field of Classification Search
None
See application file for complete search history.

(56) References Cited

U.S. PATENT DOCUMENTS 3,037,416 A * 6/1962 Cunningham ..... G10G 5/005 224/269
3,102,446 A * 9/1963 Raleigh ..... G10G 5/005 224/271
5,000,071 A * 3/1991 Thomas ..... G10G 5/005 224/910
5,069,103 A * 12/1991 Healy ..... G10G 5/005 224/910
5,202,527 A 4/1993 Gracie
5,493,941 A * 2/1996 Verge ..... G10G 5/005 403/54
5,817,961 A * 10/1998 Beck ..... G10G 5/005 84/327
6,040,509 A 3/2000 Fanella
6,250,525 B1 * 6/2001 Lehoux ..... G10G 5/005 224/257
7,009,097 B1 3/2006 Terplivetz
7,375,269 B2 * 5/2008 Perkins ..... G10D 3/003 224/910
7,423,212 B2 * 9/2008 Gallagher ..... G10G 5/005 84/421
7,709,714 B2 * 5/2010 Harbaugh ..... G10G 5/005 224/264
9,093,054 B2 * 7/2015 Werges ..... G10G 5/005
9,190,041 B1 * 11/2015 Miller ..... G10D 3/00
2009/0183621 A1 7/2009 Cianfriglia
2015/0053061 A1 * 2/2015 Coglitore ..... G10G 5/005 84/327

FOREIGN PATENT DOCUMENTS

GB 2141282 A * 12/1984 ..... G10G 5/005

* cited by examiner

*Primary Examiner* — Robert W Horn
(74) *Attorney, Agent, or Firm* — Chad Peterson

(57) ABSTRACT

Provided is a system for carrying a guitar. The system comprises a belt that wraps around a user's waist, and a cradle or guitar strap button attached to the belt that supports the weight of the guitar. The belt comprises an inner belt and an outer belt that is attached to the inner belt. The belt and cradle may comprise additional straps that extend from the belt to existing attachment points on the guitar. The belt and cradle allow a user to support a guitar without the use of a shoulder strap, to limit the strain on the shoulders of the user.

17 Claims, 3 Drawing Sheets

GUITAR WAIST BELT

TECHNICAL FIELD

This disclosure relates generally to systems and methods for a guitar strap and more specifically to a support apparatus used to assist in redistributing the weight of a guitar from the shoulder area to the waist area of a user.

BACKGROUND

Very often, guitars are played while the user is in a standing position. The traditional and most common method of holding the guitar in place while standing is to use a strap that is passed over the shoulder and across the neck while being secured to strap buttons that are typically built in to the guitar when manufactured. When using this method, all of the guitar's weight is supported by the shoulder and neck area. This has a tendency to cause discomfort, pain, and sometimes injury to the shoulder or neck area, especially after long term use.

An alternative method of holding a guitar while in a standing position is to use a belt that is secured around the waist. This method allows the guitar's weight to be redistributed from the shoulder to the waist thereby relieving pressure from the shoulder and neck area. However, most guitars typically are equipped for shoulder strap support which does not provide adequate support when using a waist belt. A variation on the waist belt is needed to provide comfort and support when holding a guitar from the waist.

SUMMARY

The present invention comprises a belt that is worn around the waist. The belt may comprise an extra or third strap button in addition to the two existing strap buttons that are typically used with a shoulder strap. The additional strap button may be positioned near the middle underside portion of the guitar body and can be either the same type of button that is typically installed for use with a shoulder strap or can be a strap button that is part of a cradle or clasp that can temporarily attach to the guitar body. Using the cradle or clasp prevents the need to make modifications to the guitar whereas installing a traditional strap button requires drilling a hole in the guitar body to screw in the strap button.

The cradle may be adjustable, so it can fit a variety of guitar widths, or it may be customized to fit a particular guitar. The cradle may be made of metal, wood, plastic, or any other material rigid enough to support the weight of a guitar. The cradle may also be coated with a silicone rubber or similar material to protect the guitar finish and provide a tacky surface to help prevent slippage.

The guitar waist belt comprises 2 belts that are secured to each other with one being an inner belt and the other an outer belt. The inner belt is secured directly to the waist and the outer belt is secured to the side portions of the inner belt. The inner belt may be secured to the waist using a hook and loop fastener or any type of buckle or connector allowing a secure fit to the waist. The outer belt may be positioned so that it would connect from near the left side of the inner belt as it is secured to the user and overlapping the front of the inner belt, then connecting to near the right side of the inner belt as it is secured to the user. A strap button connector is attached to the outer belt for securing to either the cradle or to a strap button that may be installed to the middle underside portion of the body of a guitar.

A strap may extend from near to the right side of the waist belt, and may be secured to the guitar strap button located at the end of the body of the guitar. This strap can be adjustable. A second strap may be connected to the guitar strap button located near the neck portion of the guitar. This strap connects to the strap button then extends across the backside of the guitar and is connected to near the right side of the belt using a hook and loop fastener or some type of buckle or other method of securing the strap to the inner belt.

An object of the invention is to eliminate all of the weight of a guitar from the shoulder or neck area that exists when using a traditional guitar strap to hold a guitar while standing. This can help to relieve existing shoulder and neck pain and also help prevent shoulder and neck injury caused by long term use of a traditional guitar strap.

BRIEF DESCRIPTION OF DRAWINGS

Embodiments are illustrated by way of example and not limitation in the figures of the accompanying drawings, in which like references indicate similar elements and in which.

DETAILED DESCRIPTION

The following detailed description includes references to the accompanying drawings, which form a part of the detailed description. The drawings show illustrations in accordance with example embodiments.

The guitar cradle is illustrated in FIGS. 1 through 5. The cradle may be constructed of a rigid material such as metal, wood, or plastic. The cradle may be shaped to fit and secure firmly to the middle underside portion of a particular shape, width, or style of guitar. Alternatively, the cradle may have adjustable sizing so that one size could fit many various body styles, shapes, or widths. An adjustable cradle is illustrated in the accompanying figures.

Figure 1:
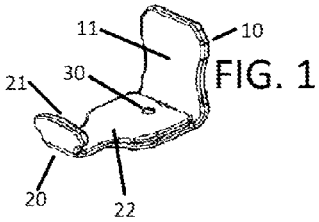
FIG. 1 illustrates a cradle according to an aspect of the invention.
Figure 2:
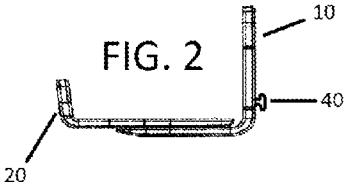
FIG. 2 is another view of a cradle according to an aspect of the invention.
Figure 3:
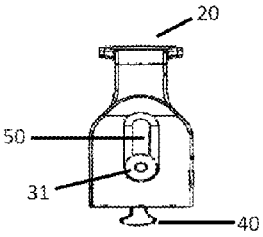
FIG. 3 is another view of a cradle according to an aspect of the invention.
Figure 4:
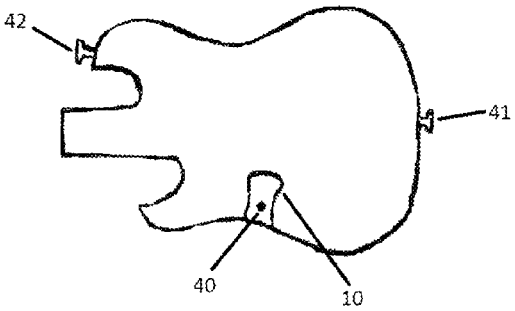
FIG. 4 illustrates a guitar with an attached cradle according to an aspect of the invention.
Figure 5:
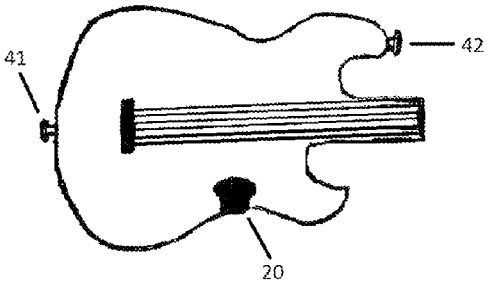
FIG. 5 is another view of a guitar with an attached cradle according to an aspect of the invention

FIG. 1 shows the top or inside portion of the cradle where the guitar body makes contact with the cradle. The cradle body is constructed of two parts that slide together; back side 10 and front side 20. Alternatively, the cradle body may be constructed of a single piece. The inside surfaces of the cradle shown in FIG. 1: e.g., 11, 21, and 22 may be coated with silicone rubber or other similar material to protect the guitar finish and also to provide a tacky surface so as to clasp the guitar tightly and prevent slippage. FIG. 1 also shows threaded screw hole 30 that supports screw 31 shown in FIG. 3. Attached to the back side of the cradle is strap button 40 shown in FIG. 2 and FIG. 3. Strap button 40 attaches to a strap that is secured to the waist belt. FIG. 3 shows slot 50 that allows sides 10 and 20 to slide back and forth to allow the cradle to be adjusted to fit the width of the guitar body. The ability of sides 10 and 20 to slide is governed by screw 31—when screw 31 is loosened, sides 10 and 20 can slide back and forth to allow the cradle to be adjusted. FIG. 4 shows the position of the back side 10 when attached to the guitar body. Cradle strap button 40 can also be seen in FIG. 4. FIG. 5 shows the position of the front side 20 when attached to the guitar body. FIGS. 4 and 5 also show built in guitar strap buttons 41 and 42 that are used to connect to straps 130 and 152 in FIGS. 6 and 7

Figure 6:
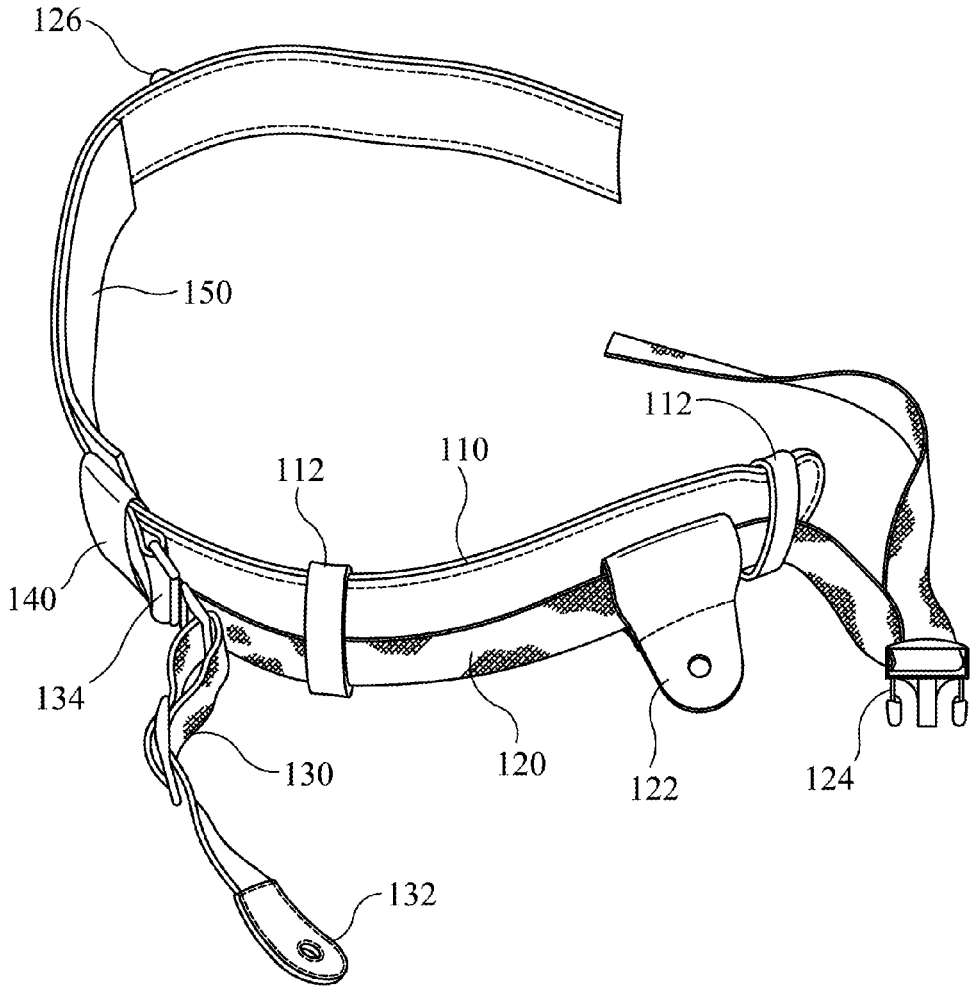
FIG. 6 is a view of a belt according to an aspect of the invention.

The belt is illustrated in FIG. 6. Turning to FIG. 6, inner belt 110 wraps fully around the user's waist and is secured using a securing means such as a hook and loop fastener. Other means for securing the belt may be used, as would be understood by one of ordinary skill in the art. Outer belt 120 is attached to inner belt 110 on the right side of the user at attachment point 134. Belt loops 112 are attached to the front portion of inner belt 110, and hold outer belt 120 against inner belt 110. Adjustable buckle 124 on the outer belt 120 attaches to buckle connector 126 on the left side of the inner belt. Strap connector 122, which is secured to outer belt 120, contains a hole that secures to a strap button that would be positioned near the middle underside portion of a guitar. Strap connector 122 is adjustable along the length of outer belt 120. Adjustable strap 130 connected to the right side of the inner belt is used to secure to guitar strap button 42 at the end of the body of the guitar using button hole 132 at the end of adjustable strap 130. The inside portion of the back side of inner belt 110 may be padded with padding 150.

Figure 7:
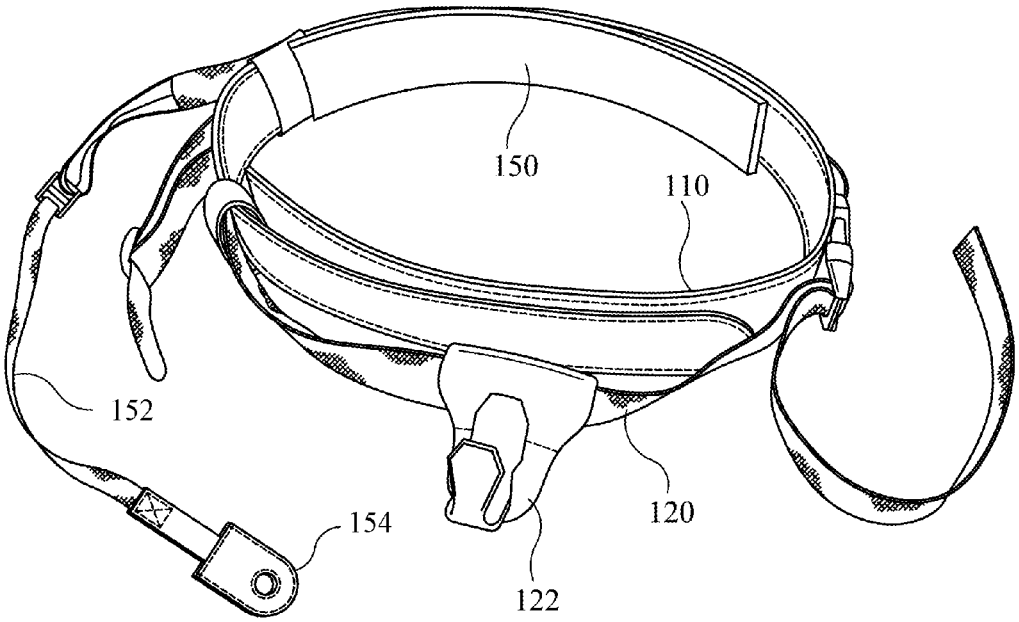
FIG. 7 is a view a the belt and cradle in combination according to an aspect of the invention.

FIG. 7 shows the inner belt as it would be when wrapped around the waist, with the cradle attached. FIG. 7 also shows a second adjustable strap, adjustable strap 152, that secures to guitar strap button 41 using button hole 154. Note that for the purpose of clarity, adjustable strap 130 is not shown in FIG. 7. One or more adjustable straps can be used, depending on the needs of the user and the type and size of the instrument. If a hook and loop fastener is used as a securing means, the fabric strips containing the hooks and loops can be secured to either side of the overlapping portion of the belt.

Inner belt 110 may be constructed of a single piece of material, or may be layered. If it is layered, the outer material of inner belt 110 may be any soft but durable material such as leather. The inside of inner belt 110 may contain a cushioned pad.

Various illustrative implementation of the present invention have been described. However, one of ordinary skill in the art, in light of the teachings herein, will recognize that additional implementations are also possible and within the scope of the present invention.

For example, the cradle could be made from a clear plastic or other transparent material that would allow it to blend with the color or design of the guitar. Additionally, the cradle is not limited to the specific implementation presented herein. The cradle can vary in size and shape and includes any device that is made to fit securely to the underside of the body of the guitar and that does not require making any modifications to the guitar. In place of using a cradle, the belt can use a strap button positioned near the middle underside portion of the guitar.

The belt could be made to use various methods for securing it to the waist such as a buckle, velcro (hook and loop fastener), or other method. Materials used to make the belt could also be of any soft but durable type that would add to the comfort and support of the belt. The width of the belt could also vary such as being wider in the back and narrower in the front to allow for more comfort and support.

Also, the straps that are used to secure to the guitar strap buttons can contain either button holes as illustrated in the figures or could be locking devices that would lock in to the guitar strap buttons.

Several alternative methods of attaching the cradle to the belt could be used such, as a device that would lock in to the belt, buckle to the belt, or snap in to the belt for additional security.

Thus, this invention is not limited to using the particular elements, materials, or components described herein, and other elements, materials, or components will be equivalent for the purposes of this invention. Accordingly, it is understood that the drawings and the descriptions herein are proffered only to facilitate comprehension of the invention and should not be construed to limit the scope thereof.

What is claimed is:

1. A apparatus for supporting an instrument while an operator of the instrument is standing, the apparatus comprising:

an inner belt that wraps around the waist of the operator;

an outer belt secured to the inner belt, the outer belt wrapping partially around the waist of the operator; and means for connecting either the inner or outer belt to the instrument.

2. The apparatus of claim 1, wherein the means for connecting comprises a clasp connected to the outer belt, the clasp constructed of a material rigid enough to support the weight of the instrument, and wherein the clasp is of a size to fit a contour of the underside including lower back side and front side portions of the body of the instrument.

3. The apparatus of claim 2 wherein the size of the clasp is adjustable.

4. The apparatus of claim 2 wherein the clasp is constructed of metal.

5. The apparatus of claim 2 wherein the clasp is constructed of plastic.

6. The apparatus of claim 1 wherein the instrument is a guitar.

7. The apparatus of claim 1 whereby none of the weight of the instrument is supported by the shoulders of the operator.

8. The apparatus of claim 2 wherein the surface of the clasp that is in contact with the guitar is coated with a tacky substance.

9. The apparatus of claim 8 wherein the tacky substance is silicone rubber.

10. The apparatus of claim 1, further comprising at least one strap attached to the inner belt or outer belt that attaches to a attachment point of the instrument.

11. The apparatus of claim 10, wherein the attachment point is a strap button.

12. The apparatus of claim 2 wherein the clasp is connected to the outer belt using a locking device, a snap, a buckle, or a button.

13. The apparatus of claim 1 wherein the width of the inner belt is greater in a back portion of the inner belt than in a front portion of the inner belt.

14. The apparatus of claim 1 wherein the inner belt comprises inner material and outer material.

15. The apparatus of claim 14 wherein the outer material is leather and the inner material is a cushioned pad.

16. The apparatus of claim 1 wherein the outer belt is secured to the inner belt by belt loops.

17. The apparatus of claim 1 further comprising a pad attached to the back inside part of the inner belt.

* * * * *